US005195315A

United States Patent [19]

Holladay

[11] Patent Number: 5,195,315

[45] Date of Patent: Mar. 23, 1993

[54] DOUBLE DOME COMBUSTOR WITH COUNTER ROTATING TOROIDAL VORTICES AND DUAL RADIAL FUEL INJECTION

[75] Inventor: Thomas E. Holladay, Lake Park, Fla.

[73] Assignee: United Technologies Corporation, Hartford, Conn.

[21] Appl. No.: 640,757

[22] Filed: Jan. 14, 1991

[51] Int. Cl.[5] ..... F23R 3/12; F23R 3/52

[52] U.S. Cl. ..... 60/39.36; 60/746; 60/756

[58] Field of Search ..... 60/39.36, 746, 747, 60/756, 752, 758, 740, 733

[56] References Cited

U.S. PATENT DOCUMENTS

| | | | |
|---|---|---|---|
| 2,687,010 | 8/1954 | Ellis | 60/747 |
| 3,132,483 | 5/1964 | Lefebure et al. | 60/747 |
| 3,333,414 | 8/1967 | Saintsbury | 60/756 |
| 3,430,443 | 3/1969 | Richardson et al. | 60/732 |
| 4,194,358 | 3/1980 | Stenger | 60/748 |
| 4,365,477 | 12/1982 | Pearce | 60/756 |
| 4,374,466 | 2/1983 | Sotteran | 60/39.36 |

OTHER PUBLICATIONS

Lefebvre, Arthur H. *Gas Turbine Combustion* McGraw Hill, New York, 1983, pp. 492–495.

*Primary Examiner*—Richard A. Bertsch
*Assistant Examiner*—Timothy S. Thorpe
*Attorney, Agent, or Firm*—Edward L. Kochey, Jr.

[57] ABSTRACT

An annular combustion chamber for a gas turbine engine establishes two toroidal primary combustion zones. This provides high combustion capacity in a short combustor. Airflow is introduced in a manner to establish the flow pattern of the vortices, and the fuel is introduced in a manner avoiding destruction of the vortices.

3 Claims, 4 Drawing Sheets

DOUBLE DOME COMBUSTOR WITH COUNTER ROTATING TOROIDAL VORTICES AND DUAL RADIAL FUEL INJECTION

The Government has rights in this invention pursuant to a contract awarded by the Department of the Air Force.

DESCRIPTION

1. Technical Field

The invention relates to combustors and in particular to combustors for gas turbine engines 2. Background of the Invention The single toroidal combustor has been developed and used for years by Pratt & Whitney Canada, Inc.

In such a combustor a vortex is established by the introduced air flow rather than the fuel flow. Air is introduced tangentially along the surface of the semicircular head of the combustion chamber. This cools the surface and sets up a vortical flow of air.

Adjacent to this toroidal area a sheet flow of air is introduced in the opposite direction. This trips the swirling air flow off the wall. Discrete jets at this location penetrate the air flow pattern and promote turbulence and also to help set up the vortex.

Fuel is injected into the vortical air flow with low momentum compared to the air flow. The fuel thereby penetrates into the swirling combustion zone without disturbing the air flow of the vortex.

Complex swirler devices are not required. Fuel injector design is simple since the flame stabilization factors are built into the air flow field. Radially mounted injectors are possible. Liner cooling flow participates in the combustion process. The entire front end volume can be better used by spraying with a circumferential component as compared to axial injectors.

The drive to reduce gas turbine engine length is forcing the combustor toward lower aspect ratios; that is length divided by height. The larger dome heights make it difficult to distribute the fuel radially in the dome with a single row of fuel nozzles. Several concepts have been evaluated using double rows of closely spaced fuel nozzles to distribute the fuel radially into the dome. This results in an excessive number of fuel nozzles/-swirlers which increase cost and weight.

The single toroidal combustors work well for small combustors. For larger combustors however, the dome height is increased, forcing length to increase.

SUMMARY OF THE INVENTION

Annular combustion chambers are formed in a normal manner with inner and outer peripheral walls. The head of the combustion chamber is however formed of two arcuate forms each being substantially semi-circular. Within each arcuate form is a plurality of directional wall jets or louvers introducing air parallel to the surface, all in the common direction toward or away from the junction between the arcuate forms.

At the junction of the arcuate forms, central jets are located directing air along the surface of the arcuate forms away from the junction. Peripheral jets are located on the inner and outer circumferential walls and arranged to direct air tangent to the walls toward the head structure.

One of either the central jets or the peripheral jets are established as a trip louver, these introducing the air in a sheet or continuous film flow. This trip louver is selected as the one introducing flow opposite to the directional jets.

Immediately downstream of the trip louver is a plurality of openings establishing discrete jets of air perpendicular to the air flow passing from the louvers.

The method of introducing the air flow establishes a vortex associated with each arcuate form. Fuel is sprayed into the center of each vortex with a low momentum compared to the air flow. A high quantity of atomizing air used for introduction of fuel would be destructive of the air induced vortex. The arrangement is selected so that the conventional flame front established by the fuel is not formed which would upset the air flow established by the selective introduction of air.

DESCRIPTION OF THE PREFERRED EMBODIMENT

Figure 1:
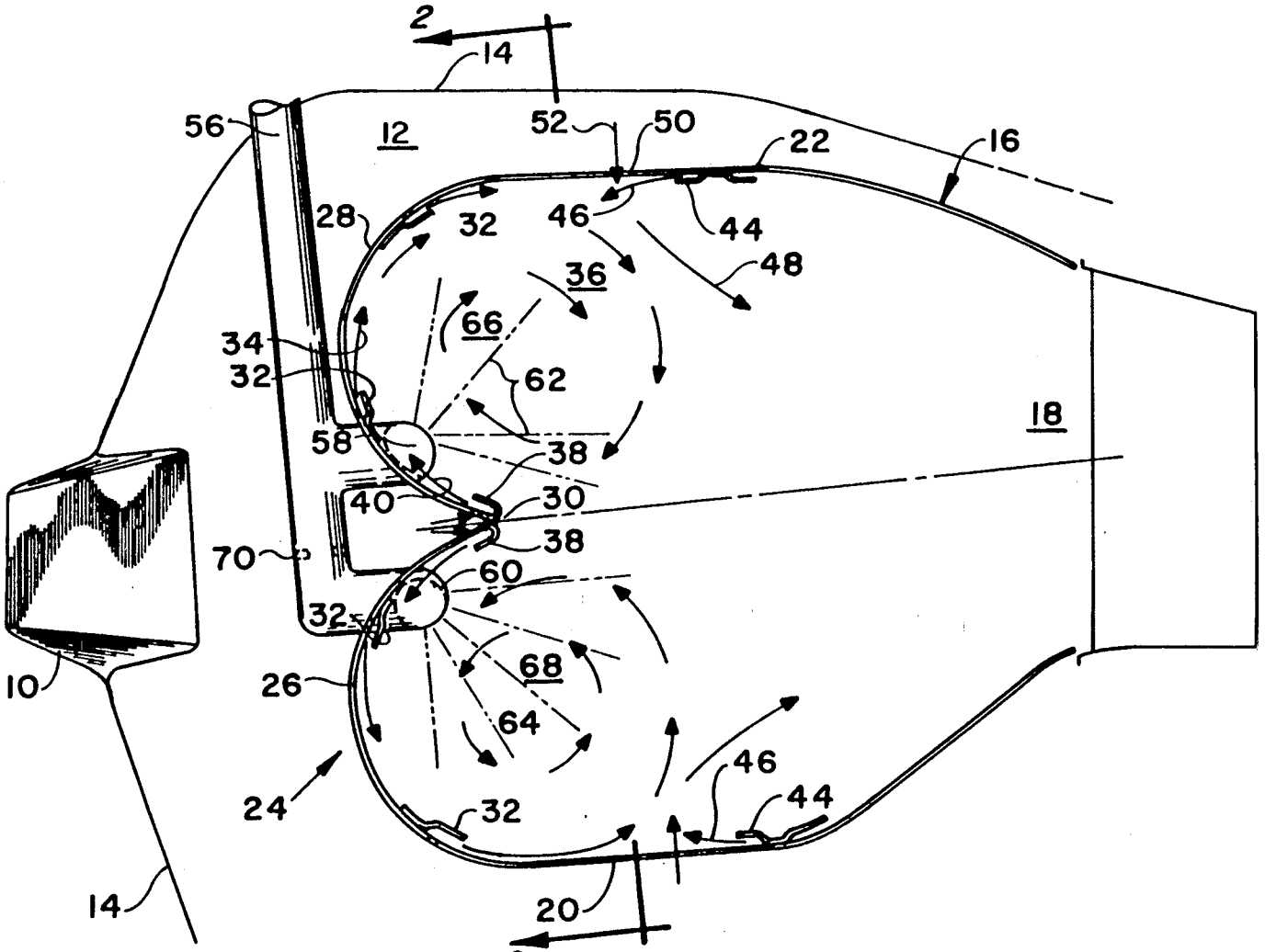
FIG. 1 is a sectional view through a combustor annulus.

Referring to FIG. 1 an annular air diffuser 10 receives air from the compressor (not shown) and delivers it to air plenum 12. This plenum is formed between pressure confining boundaries 14 and contains an annular combustor 16. Combustion gases pass through exit 18 to the gas turbine (not shown).

Combustor 16 is formed of an inner circumferential wall 20 and an outer circumferential wall 22. At the upstream end head 24 joins walls 20 and 22.

Head 22 is comprised of an inner substantially arcuate form 26 and an outer substantially arcuate form 28. These two are joined at junction 30. Each arcuate form is generally smooth throughout to avoid vortices other than the ones established by the jets described hereinafter.

Directional jets 32 (with louvers if desired) at different arcuate locations are arranged to introduce air 34 tangent to the arcuate form in which each is located. These jets may be either discrete jets or a sheet of air, the primary function of these jets being to establish the predominant influence established vortex 36. They also serve the function of cooling the surface of arcuate forms 26 and 28, and the distribution of each jet along with any cooling air coming from upstream must be considered in designing the particular jet arrangement.

Center jets 38 are located at the junction 30 and direct an air flow 40 tangent to the arcuate forms in the direction away from the junction. When the directional jets are directed in the same direction as the central jet, the central jet has the same criteria and the same functions as the directional jets.

Peripheral jets 44 are located on the inner and outer circumferential walls and arranged to direct an air flow 46 tangent to the walls toward head structure 24. Where these peripheral jets are directed opposite to the directional jets 32 as illustrated in FIG. 1, it is essential that the air flow 46 be a sheet of air rather than a plurality of discrete jets to ensure circumferential uniformity. Where this peripheral jet is projecting flow opposite to the directional jets, peripheral jets 44 are designated as trip louvers. The air flow functions to trip the flow off the wall directing it to inner zone 48 and to force a portion of the flow into vortex 36.

Downstream of each louver with respect to the air flow 46 openings 50 provide for a radial air flow 52 in a form of a plurality of discrete jets. These jets penetrate through the sheet of air contributing appropriate turbulence and mixing it into the overall combustion process.

Fuel for combustion is delivered through inlet pipe 56 and delivered to fuel nozzles 58 and 60. these fuel nozzles deliver sprays 62 and 64 into the central volume of vortices 66 and 68, respectively. It is essential that this spray not have a high momentum which would cause the conventional vortices and recycling zones known to be generated by the flame front. It is critical that the flow pattern in these vortices be established by the air introduction pattern and not overridden by excess momentum in the fuel supply. Accordingly, in the event that atomizing air is used, it should not be more than five (5) percent of the total air flow passing through the other described jets.

Since combustor 16 is annular it follows that the volume of the annulus formed by vortex 68 is less than the volume of the annulus formed by vortex 66. Accordingly, it is preferred that the introduced fuel be adjusted so that a higher percentage of the fuel passes through nozzle 58 than nozzle 60. While this can most easily be done by varying the number of nozzles or the size of the nozzles, an orifice 70 is here illustrated as one means for skewing the flow between these two nozzles.

Figure 2:
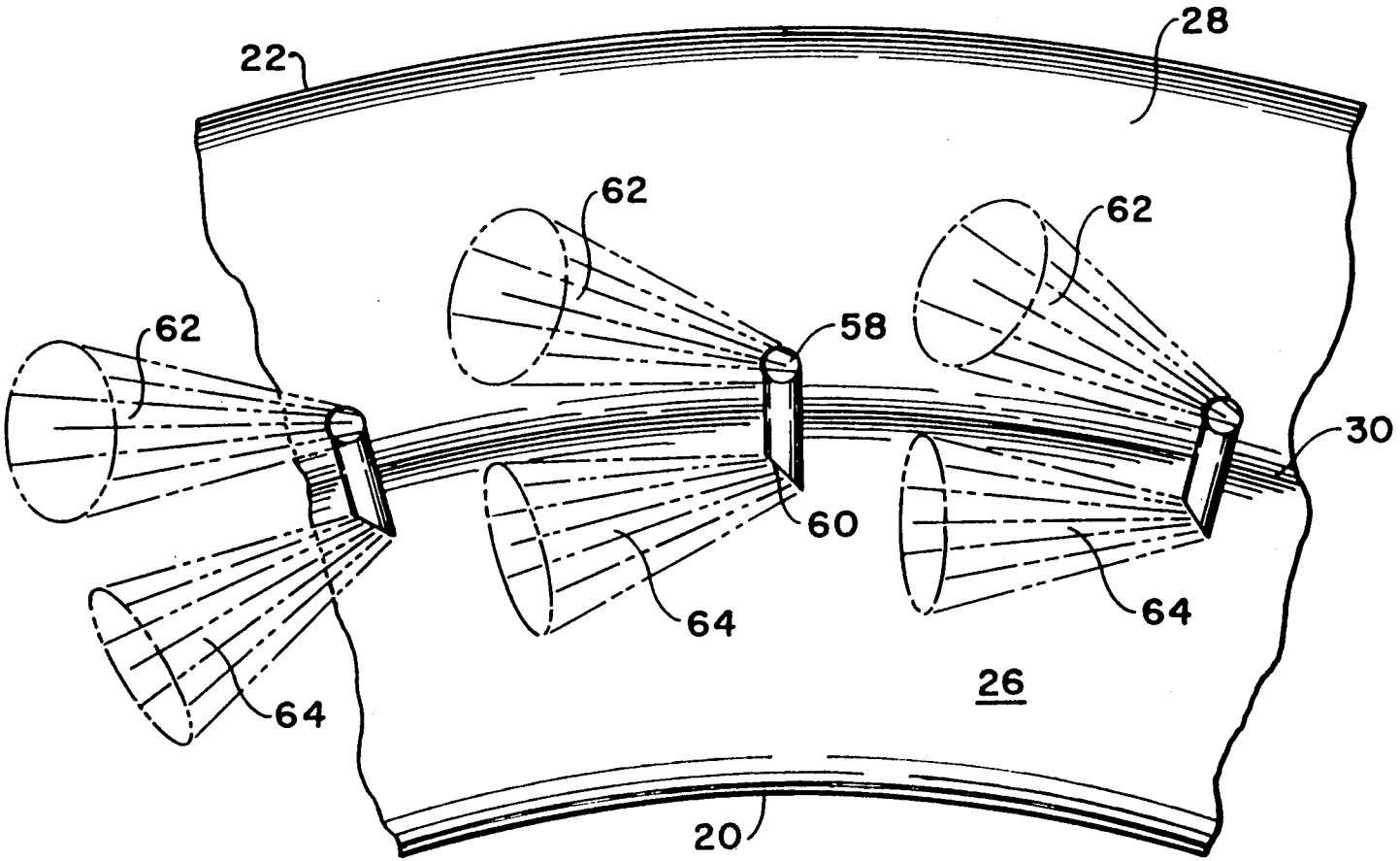
FIG. 2 is a partial section looking toward the head and showing the fuel injection pattern.

FIG. 2 is a view from within the combustor looking toward the head structure 24. The circumferential component of the fuel injection sprays 62 and 64 can be seen. While the incoming air does not have a circumferential component and accordingly forms a vortex without circumferential flow, the fuel nozzles are preferably aimed with this circumferential component thereby more effectively using the volume of the vortices without the need for a large number of fuel nozzles.

Figure 3:
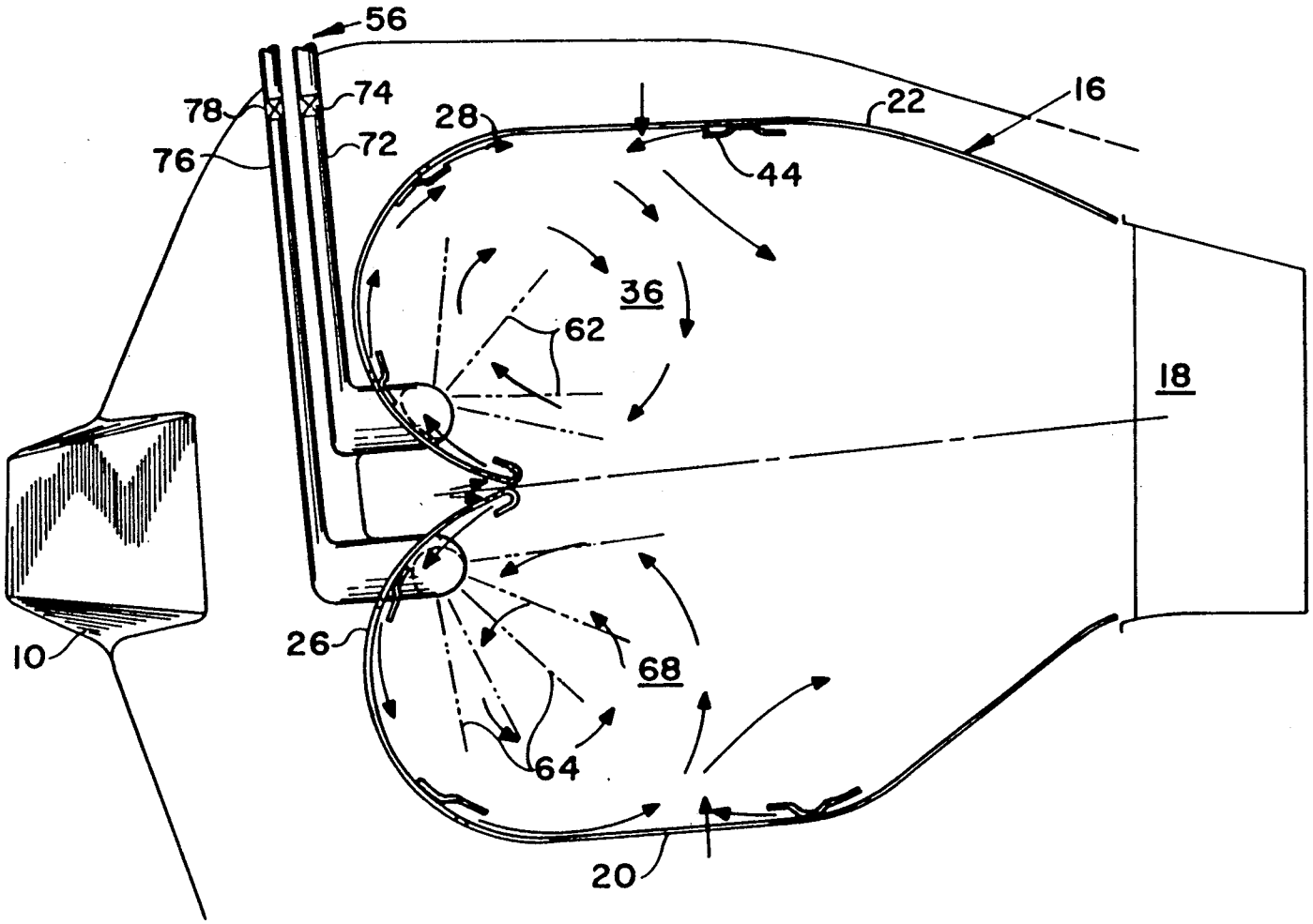
FIG. 3 is a section view similar to FIG. 1 but showing separate fuel supply to each vortex.

FIG. 3 is substantially the same as FIG. 1 except for the controlability of the fuel to the two vortex areas. The fuel input line 56 is formed of outer chamber supply line 72 containing outer chamber fuel valves 74 and inner chamber fuel supply line 76 containing inner chamber fuel valve 78. As load is reduced on a gas turbine engine, the required fuel flow decreases more rapidly than the required air flow. Normally, therefore the temperature in the combustion zone tend to decrease, with the potential for delaying the process of combustion. With the separate control over the two vortex zones, at reduced loads one of these may be closed down with all of the fuel passing into the other vortex. Since the fuel has dropped more than the air flow on an overall basis, the temperature increase in the fixed combustion zone is not excessive, and the momentum of the fuel flow being supplied to only one chamber does not override the air flow of the vortex.

Figure 4:
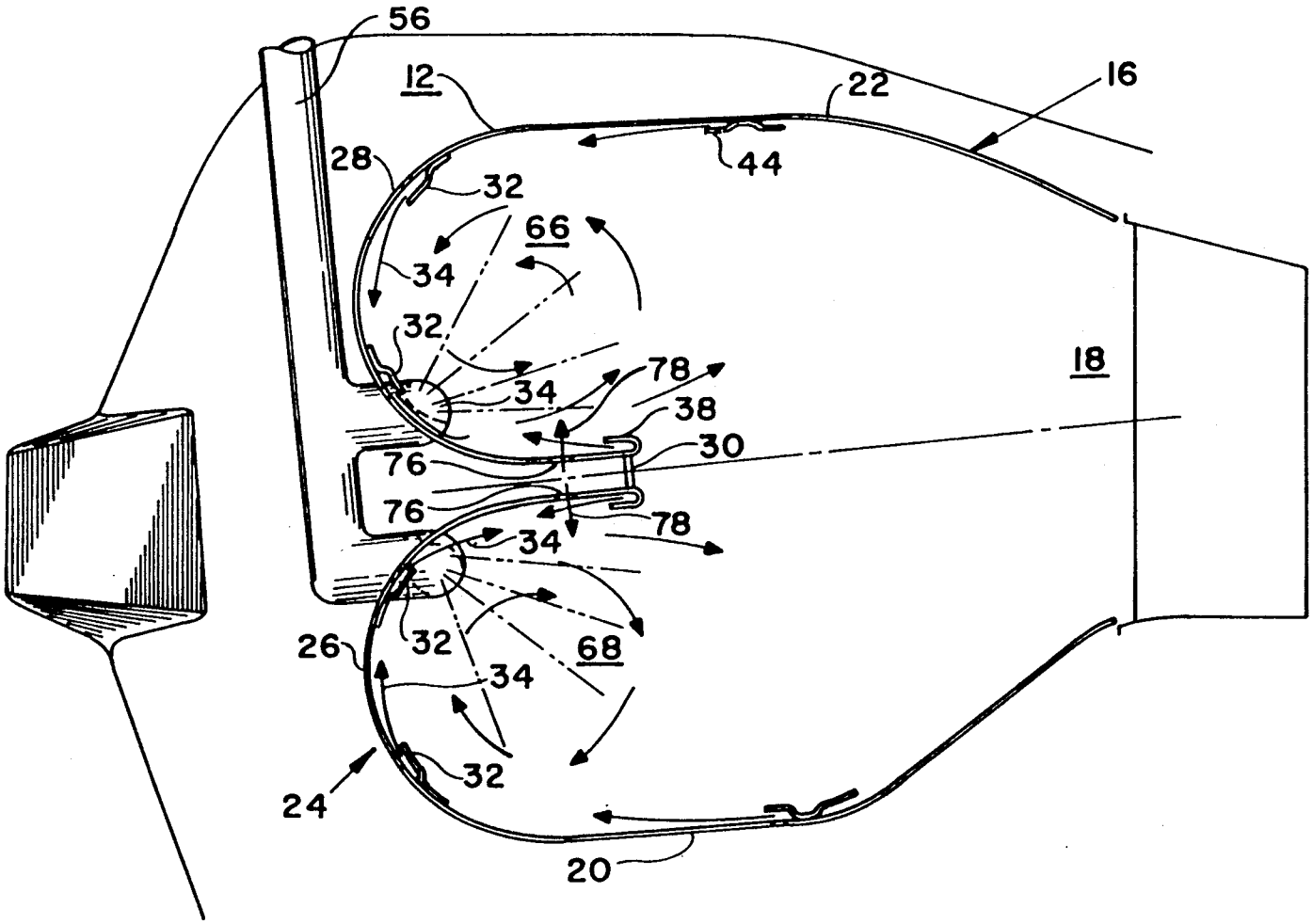
FIG. 4 is a sectional view through a combustor annulus showing a vortex directed reverse to that of FIG. 1.

FIG. 4 illustrates a combustors 16 with the direction of vortices 66 and 68 being opposite of the direction in FIG. 1. It can be seen that directional jets 32 are established to produce air flow 34 in the opposite direction. Jets 38 and 44 still produce flows in the same direction as in the previous embodiment. However, jet 38 is the trip louver introducing a sheet of air in this embodiment with openings 76 producing discrete jets 78 penetrating into the combustion zone.

I claim:

1. A dual toroidal combustor for a gas turbine engine comprising:

an annular combustor chamber having an inner circumferential wall, an outer circumferential wall, and a head structure joining said inner and outer circumferential walls at the upstream end, and an open annulus for gas egress at the end opposite said head structure;

said head structure comprising an inner substantially semi-circular inner arcuate form adjacent said inner circumferential wall and an outer substantially semi-circular outer arcuate form adjacent said outer circumferential wall, and a junction where said inner and outer arcuate forms join;

a plurality of directional jets at different arcuate locations on each arcuate form arranged to introduce air tangent to said arcuate forms, all directional jets having a common orientation with respect to said junction between said inner and outer arcuate forms;

central jets located at said junction of said inner and outer arcuate forms arranged to introduce air tangent to said arcuate forms in the direction away from said junction;

peripheral jets located on said inner and outer circumferential walls arranged to direct air tangent to said walls towards said head structure;

the central jets or peripheral jets direction flowing in a direction opposite said directional jets being designated as trip louvers;

said trip louvers arranged to introduce a sheet of air flow and having downstream thereof an opening in the downstream boundaries for admitting trip jet airflow perpendicular to the trip louver flow;

fuel injection nozzles arranged to directly inject fuel toward and into the center of a circle formed by each arcuate form; and each fuel nozzle having no air mass flow therethrough.

2. A combustor as in claim 1 further comprising: said directional jets all oriented to introduce air away from said junction between said arcuate forms.

3. A combustor as in claim 1 further comprising: said directional jets all oriented to introduce air toward said junction and said arcuate forms.

* * * * *